US005176379A

United States Patent [19]

Reinberg

[11] Patent Number: 5,176,379

[45] Date of Patent: Jan. 5, 1993

[54] GOLF CLUB PUTTER

[75] Inventor: Richard D. Reinberg, Boca Raton, Fla.

[73] Assignee: Devcorp of America, Inc., Boca Raton, Fla.

[21] Appl. No.: 755,545

[22] Filed: Sep. 5, 1991

[51] Int. Cl.[5] ..... A63B 53/04; A63B 53/14

[52] U.S. Cl. ..... 273/80 C; 273/167 G; 273/167 F; 273/167 J; 273/168; 273/169

[58] Field of Search ..... 273/167–175, 273/164, 77 R, 80 R, 80 C, 163 R, 163 A, 77 A, 129 K

[56] References Cited

U.S. PATENT DOCUMENTS

| | | | |
|---|---|---|---|
| 2,708,579 | 5/1955 | Hugman | 273/169 X |
| 2,843,384 | 7/1958 | Schmidt | 273/167 G X |
| 3,042,405 | 7/1962 | Solheim | 273/168 X |
| 3,574,349 | 4/1971 | Kropp | 273/167 G X |
| 4,010,958 | 3/1977 | Long | 273/169 |
| 4,163,554 | 10/1979 | Bernhardt | 273/80 C |
| 4,295,650 | 10/1981 | Keeble | 273/168 X |
| 4,339,133 | 7/1982 | Warehime | 273/129 K X |
| 4,426,083 | 1/1984 | Dishner | 273/168 X |
| 4,519,612 | 5/1985 | Tsao | 273/167 A X |
| 4,621,816 | 11/1986 | Leek | 273/168 |
| 4,714,252 | 12/1987 | Roraback | 273/167 A X |
| 4,964,639 | 10/1990 | Tucker | 273/167 A X |

FOREIGN PATENT DOCUMENTS

| | | | |
|---|---|---|---|
| 0370530 | 5/1990 | European Pat. Off. | 273/167 G |
| 14850 | of 1904 | United Kingdom | 273/168 |
| 8336 | of 1906 | United Kingdom | 273/168 |

OTHER PUBLICATIONS

"Golf Digest" Magazine, Feb. 1988 Issue, p. 111.
"Golf World" Magazine, Jun. 19, 1964 Issue, p. 4.

*Primary Examiner*—William H. Grieb
*Assistant Examiner*—Sebastiano Passaniti
*Attorney, Agent, or Firm*—George Wolken, Jr.

[57] ABSTRACT

The present invention comprises a golf club putter having a curved lower surface and a vertically-upward directed shaft, the combination thereof allowing the golfer to strike the ball while holding the shaft at substantially any angle from true vertical to an angle deviating at least 10 degrees from vertical, and to employ a variety of putting strokes. Additionally, the putter of the present invention is weighted on the heel and toe ends thereof such that the club rests in balance when placed on the putting surface with the shaft having any angle with respect to said putting surface from true vertical to an angle of at least 10 degree deviation from vertical. The structure of the present putter allows special putting procedures to be used by the golfer.

4 Claims, 2 Drawing Sheets

FIG. 1
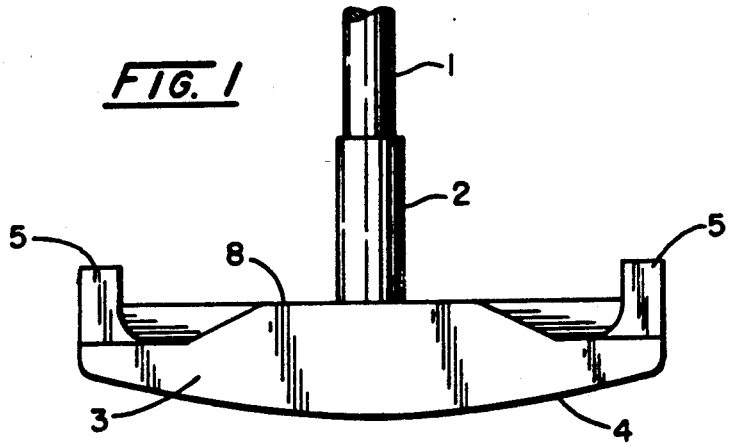
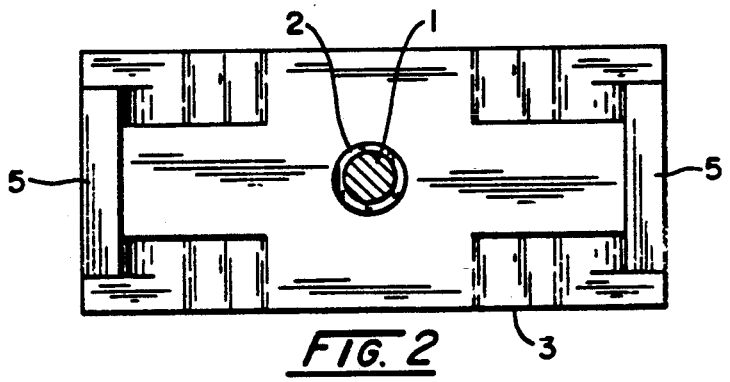
FIG. 2
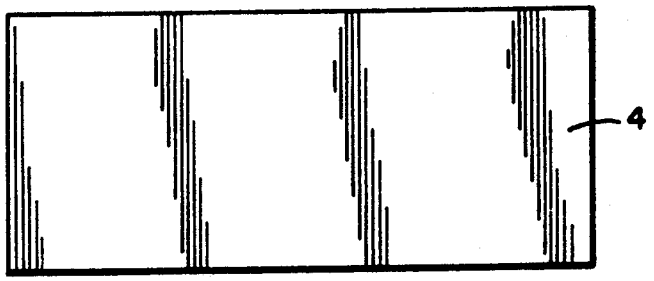
FIG. 3
FIG. 4
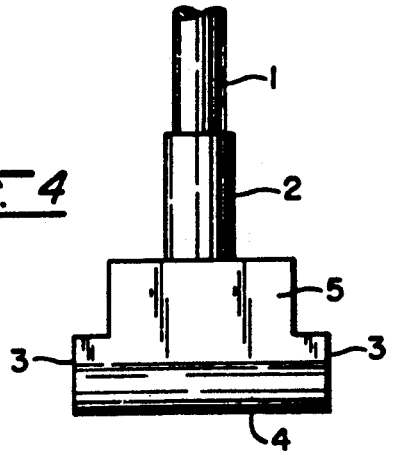

GOLF CLUB PUTTER

BACKGROUND OF INVENTION

The present invention relates to the field of golf club putters. More particularly, the present invention relates to a design for a golf club putter in which the golfer can effectively strike the ball holding the shaft in any position from substantially vertical to an incline of at least 10 degrees with respect to vertical, and provides the golfer with symmetry and balance in the putter when using an upright style of putting stroke.

Two authors have estimated that putting comprises 43% of the game of golf ("Putt Like the Pros", by Dave Pelz and Nicholas Mastroni, Harper & Row, 1989, page 4). Therefore, considerable effort has been expended on analysis of putting and ways to improve a golfer's score by more accurate putts.

Putting a ball into the cup involves essentially two distinct steps. In the first step, the golfer must choose the path of the ball over the green from its present position into the cup. The second step has the golfer striking the ball in such a way as to cause it to follow the planned trajectory into the cup. Both steps are very complicated.

In choosing the path of the ball over the putting surface into the cup (that is, the "line" of the putt), the contour of the green is the first consideration for many golfers. The overall contour determines the curvature of the golf ball as it approaches the cup (that is, the "break" of the putt). In addition, the friction of the ball with the green (the "speed" of the green) must be considered in determining the correct speed for the putt. Obviously, the ball must reach the cup to have any chance of going in. But balls moving too rapidly also cause problems. A ball approaching the cup at too high a speed can strike the rim of the cup and be deflected away from the hole, whereas a slower-moving golf ball will not ricochet as much from the rim of the cup and probably fall into the hole. Also, putts travelling too fast will result in a longer return putt to the hole in the event of a miss. The speed of the green is determined by such factors as the length and type of grass, the natural slant of grass growth (the "grain" of the green), the moisture content of the grass and soil, and occasionally in competition, even by wind conditions.

All the above factors affecting the speed of the green are to be considered in addition to the uphill and downhill rolling of the putt following the overall undulations of the green itself. Further complicating matters is the fact that the curvature in the path of the rolling golf ball ("break") is itself determined in part by the speed at which the ball is rolling. Thus, it is quite possible for a ball rolling too quickly to fail to follow the contour of the green as expected by the golfer, tending to prefer a trajectory closer to a straight line in accordance with Newton's laws. This results in "hitting through the break", and a missed putt. Thus, the complex art of putting is further complicated by the fact that the correct line for the putt is not entirely separate from speed of the ball as determined by the way it is struck. The many factors of putting are interrelated and affect the trajectory of the putt in a complex way.

Once the golfer has determined the line of the putt (including consideration of the speed), the next problem is to strike the ball so as to cause it to follow this line. Pelz and Mastroni (cited above) report in their Chapter 5 on controlled experiments in rolling golf balls towards a hole in which essentially all variables in starting the golf ball on its way have been eliminated through careful engineering. Even under these near-ideal conditions, many putts are missed. The authors conclude that even extremely well-groomed greens are subject to small variations in surface structure (spike marks, imperfectly repaired ball marks, small variations in sod contours, etc.) making the trajectory of a golf ball subject to random disturbances beyond the control of even the most dedicated student of putting. Thus, making 100% of one's putts is not possible on real greens, even in theory. However, the quest of many golfers is to make all the putts they reasonably can. This leads at once to the problems of striking the ball in such a way as to start it properly on the desired path.

The human golfer is subject to many imperfections in his or her putting stroke. Numerous books (including that cited above) attempt to describe many of these putting problems and suggest solutions. Of course, the major problem is not simply an imperfect stroke for which compensation may be possible. The major concern is the variation of the putting stroke from shot to shot, leading to unpredictable putting results. The elimination of shot to shot variation is thus a major concern of golfers.

Two basic approaches are taken in a golfer's attempt to bring predictability and reproducibility into his or her putting stroke. First, lessons and practice to train the body are employed, attempting thereby to condition the muscles to act in coordination the same way from stroke to stroke. Secondly, golfers frequently choose equipment which minimizes or reduces the adverse consequences of their particular putting problem. The thrust of the present invention is towards a new style of putter offering advantages and flexibility for the individual golfer in selecting his or her most advantageous putting stroke.

There are essentially two considerations in selecting equipment for the game of golf (in this case, a putter). The particular piece of equipment must be suitable for the golfer, feel comfortable to him or her, and provide a modicum of advantage as perceived by the golfer over other choices of equipment. Secondly, for many golfers it is necessary that the equipment meet the requirements of the U.S. Golf Association (or another recognized rule-making body) and, therefore, be acceptable for use in private or tournament competition, be acceptable in determining recognized handicaps, and avoid unfair advantages for a particular golfer. The official rules of golf change from time to time, often in response to technical advances in equipment. Therefore, one cannot predict 100% reliably whether a new club will be "conforming", in the absence of an official determination by the appropriate ruling body. However, it is one intent of the inventor that the putter of the present invention is apparently in conformity with the rules of golf as commonly understood and applied by golfers in the United States of America. If, however, the club of the present invention is found to lack conformity with the rules of golf, or the rules are specifically altered to make this club nonconforming, the utility and novelty of the present invention will in no way be affected for those many golfers who simply wish to enjoy the game on their own terms.

In selecting suitable golf equipment, many factors are taken into consideration by the individual golfer. For the case of putters, the golfer considers the balance of the club in his or her hand; the weight of the clubhead and its distribution; the structure of the club in terms of ease of alignment, sighting marks, shape, color, etc., and the size and location of the "sweet spot" (that is, the region on the clubhead wherein the golf ball may be struck without causing serious rotation of the clubface during impact and resulting misdirection of the putt). Many types of clubs have been developed to address in various ways some or all of these factors. Full consideration of these is beyond the scope of our present discussion and not required for a complete understanding of the present invention.

An important factor not typically addressed by present putters is the angle made by the shaft with the putting surface in the region of the ball. Typically, in addressing the ball for a putt using a conventional putter, the clubface is held near the ground and aligned with the ball for putting. When held in this position by the golfer, the club shaft typically makes a certain and fixed angle with the local plane of the green. If the golfer attempts to strike the ball holding the shaft at a different angle from that for which the putter was constructed, the clubface strikes the ball at an incline, typically adversely affecting the dynamics of the club-ball impact. Using conventional putters, it is important for the golfer to select a putter for which this angle of shaft and green is comfortable for him or her as there is typically no variation possible to account for local variations in the angle of the green, or in the preferences of the particular golfer. The present invention provides a single putter in which the ball may be struck effectively with the shaft in any position from vertical to an angle at least 10 degrees from vertical.

The present putter utilizes a curved clubface which allows the ball to be struck with the shaft held at any angle desired by the golfer from true vertical to at least 10 degree deviation from vertical. No matter which angle the golfer chooses to hold the shaft in striking the ball, effectively equivalent striking areas and geometries of clubface make impact with the golf ball. This should be contrasted with the invention of Guendling (U.S. Pat. No. 4,523,758) in which an angled clubface is employed. When used in a vertical position as suggested by Guendling, the golf ball is struck by the apex of a "V". When held at the appropriate angle from vertical (as determined by the angle of the "V"), the golf ball is struck by a substantially flat clubface. When held at an intermediate angles, the golf ball is struck by an inclined clubface. The present putter eliminates this variation in the impact zone of ball and clubface by the use of a curved and balanced clubhead as described fully below.

The structure of the present putter should also be contrasted with that of Bernhardt (U.S. Pat. No. 4,163,554). Bernhardt suggests using a modified two-handed croquet-style putting stroke, putting the ball from a position next to the golfer while the golfer faces along the direction of the putt. The putter proposed by Bernhardt has a substantially flat portion along the bottom of the striking face and has a shaft emanating from the putting head at an angle. The putter of the present invention can also be used in such an upright style, forward-facing putting stroke. However, the centrally located shaft of the present club (combined with the curved bottom of the striking face) allows the golfer using the putter of the present invention to employ a truly vertical putting motion in striking the putt.

The club of the present invention, with its combination of vertical shaft, curved clubhead, and symmetrical structure, allows many different putting strokes to be used with the same club. The present club can accept a short shaft, thereby permitting the golfer to use the one-handed putting stroke suggested by Guendling. The use of the present putter with a longer shaft allows one to use a conventional putting stroke. An even longer shaft on the present club allows the golfer to use the forward-facing upright style of stroke suggested by Bernhardt. Alternatively, as described fully below, the use of a longer shaft on the present club allows the golfer to employ an upright style of stroke while facing the golf ball in a conventional putting address position.

SUMMARY AND OBJECTS OF INVENTION

The present invention comprises a golf club putter having a curved lower surface and a vertically-upward directed shaft, the combination thereof allowing the golfer to strike the ball while holding the shaft at substantially any angle from true vertical to an angle deviating at least 10 degrees from vertical, and to employ a variety of putting strokes. Additionally, the putter of the present invention is weighted on the heel and toe ends thereof such that the club rests in balance when placed on the putting surface with the shaft having any angle with respect to said putting surface from true vertical to an angle of at least 10 degree deviation from vertical. The structure of the present putter allows special putting procedures to be used by the golfer.

A primary object of the present invention is to provide a golf club putter having a curved lower surface and a vertical shaft directed upward from the midpoint of the clubhead and centrally located thereon.

Another object of the present invention is to provide a golf club putter which can be used to strike the ball with the shaft thereof at any angle with respect to the putting surface from true vertical to an angle of at least 10 degree therefrom.

Another object of the present invention is to provide a golf club putter which will rest unsupported on the putting surface with the shaft thereof having any angle with respect to said putting surface from true vertical to an angle of at least 10 degree deviation from true vertical.

Yet another object of the present invention is to provide a golf club which can strike the ball with a substantially equivalent striking face while the shaft thereof has any angle with respect to the putting surface from substantially vertical to an angle at least 10 degree deviation from vertical.

Another object of the present invention is to provide a putter capable of striking the ball in a substantially vertical plane using either a single- or double-handed grip.

Yet another object of the present invention is to provide a putter capable of use in both a substantially vertical striking motion or with a convention angular stroke directed against the ball from a golfer standing alongside and facing said ball.

Another object of the present invention is to putt the golf ball using a substantially vertical two-handed stroke in a highly reproducible putting motion.

BRIEF DESCRIPTION OF DRAWINGS

FIG. 1: A front view of the head of the golf club putter of the present invention viewed at approximately the level of the putting surface. The symmetry of the club causes the front face and the rear face to be the same, allowing use by both right-handed and left-handed golfers.

FIG. 2: Top view of the head of the golf club putter of the present invention.

FIG. 3: Bottom view of the head of the golf club putter of the present invention.

FIG. 4: End view of the head of the golf club putter of the present invention viewed at approximately the level of the putting surface. The symmetry of the club causes the heel and toe ends of the clubhead to be the same.

DESCRIPTION OF PREFERRED EMBODIMENTS

Figure 5A:
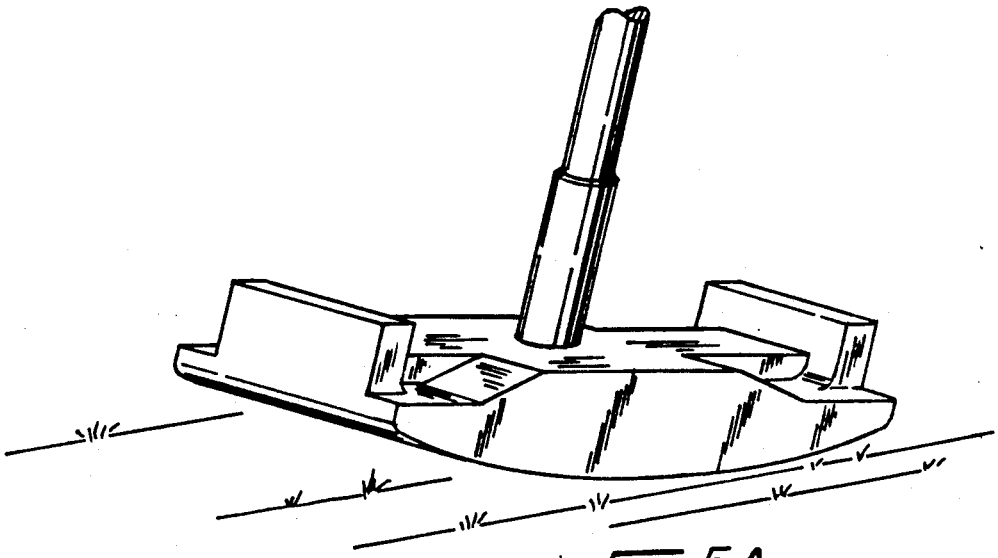
FIG. 5: The putter of the present invention as it would typically be used by a golfer employing a conventional putting stroke addressing the ball (not shown) while holding the shaft at an angle of at least 10 degree deviation from vertical.

FIG. 1 shows a typical embodiment of the present invention as viewed from the level of the putting surface (that is the green). The shaft, 1, is directed vertically upward from the center of the clubhead. In contrast to the invention of Guendling, the club of the present invention can have a shaft of any convenient length as desired by the particular golfer. The present putter can easily be used in combination with a relatively short shaft (following Guendling) if a one-handed putting stroke is desired. However, nothing in the present invention is limited to the use of a short shaft. A normal length shaft can just as well be employed when striking the ball in a conventional putting stroke as shown in FIG. 5. Not limited to short and standard sizes of shaft, the putter of the present invention can also be used in combination with a very long shaft. Such long shafts are becoming increasingly common as more and more golfers seem to prefer an upright putting stroke with a long shaft, often guided during alignment and stroke by resting the upper portion of the putter against the golfer's shoulder. The present putter can effectively be used with all types of shafts, depending only on the preference of the particular golfer.

FIG. 1 shows the shaft as attached to the clubhead by means of a hosel 2, leading to a more or less permanent attachment of the shaft to the clubhead. It is not necessary for the present invention that a hosel be employed. The club of the present invention can be used quite effectively having a shaft attached by means of simple screw attachment into a threaded hole in the upper face of the putting clubhead, or by any other attachment means well known in the art. The hosel attachment shown is a typical means of attachment, but by no means the only one possible or desirable with the present invention. A detachable shaft, typically by means of threading or gluing the shaft into a suitable hole in the clubhead, will allow the golfer the flexibility of experimentation with different lengths, weights, grips, etc. for the shaft with a single club. However, detachable shafts may lead to a loosening of the attachment during a round of golf, either by use in putting or by normal agitation in the golf bag during transport. In such circumstances, the golfer may be concerned about reorientations of the clubhead during the putting stroke, and resulting misdirection of the putt. In summary, the means of attachment of the shaft to the clubhead is not a crucial feature of the present invention. The individual golfer is free to select the combination of shaft and shaft attachment means which best suits his or her taste and putting style.

We show the striking surface of the clubhead as 3. The club is moved in a direction substantially perpendicular to this plane, 3, striking the ball with this flat surface. As shown, the striking surface, 3 is substantially perpendicular to the putting surface of the green and parallel to the longer symmetry plane of the clubhead which contains the shaft. However, in many clubs, the striking face is not precisely perpendicular to the intended direction of putting. Moreover, in many modern putters, the striking face is inclined at an angle of typically 2 degrees from true vertical. This inclination is typically in the direction causing the upper part of the striking face, 3 to be inclined away from the golf ball as said ball is struck. The intent of this small deviation from true verticality is to prevent the golf ball from hopping slightly when struck. Such hopping motion, even through very small, is thought to be sufficient to cause significant deviation from the true putting line, and missed putts. The club of the present invention can be effectively used with a striking face, 3 as true vertical or at any small incline from true vertical, as desired by the golfer and designed into the clubhead.

Figure 6A:
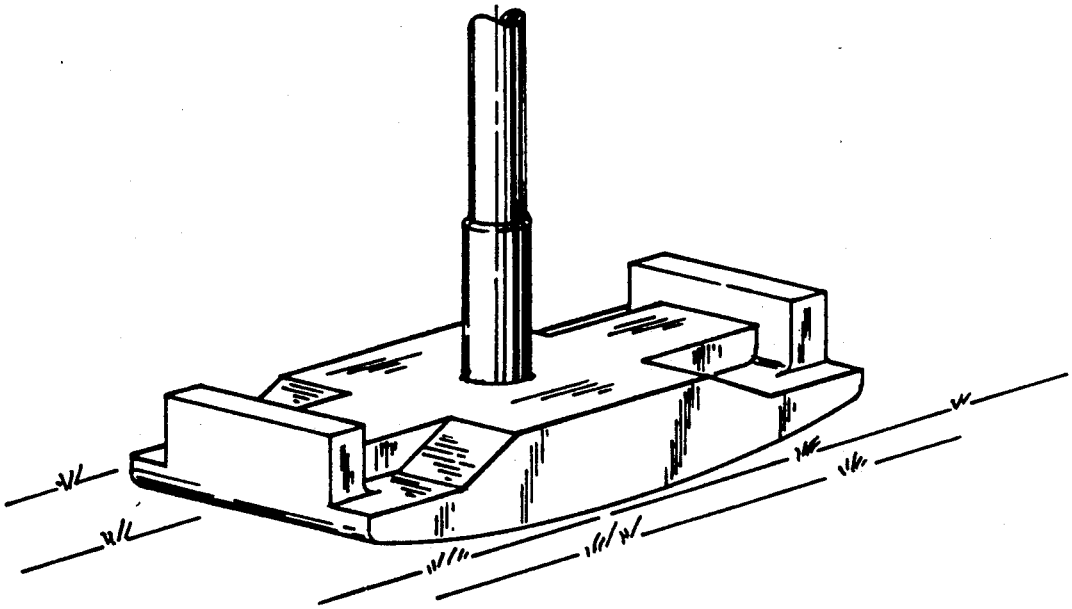
FIG. 6: The putter of the present invention as it would typically be used to execute a vertical putting stroke.

One of the key features of the present invention is the curved lower surface of the club, 4. The curvature of this surface is sufficiently gentle as to provide for a clubhead longer than it is wide, in compliance with conventional rules of golf. Also, the curvature of this clubhead is such that when used with a conventional putting stroke (FIG. 5), the ball is struck in a solid and direct fashion with the striking face, 3. However, the curvature of the clubface, 4, is sufficiently gentle that when used in a vertical stroke, (FIG. 6) a direct and solid impact with the ball is achieved. This should be contrasted with the club of Guendling in which a vertical putting stroke results in the ball being struck with the apex of a "V". The putter of the present invention should also be contrasted with the club of Bernhardt in which a vertical putting stroke, as in FIG. 6, is quite impractical with the angled shaft of Bernhardt.

Another key feature of the present invention is the weight provided by "outriggers", 5. The function of the outriggers is to provide additional weight at the toe and heel ends of the club to provide better balance in the putting stroke when used in conventional putting fashion as shown in FIG. 5. In addition, the weight of the outriggers is selected to provide neutral balance to the putter when placed on the ground with the shaft making any angle from true vertical to a deviation of at least 10 degrees from vertical. That is, the weight of the outriggers, 5, is to be selected such that the golf club will remain in balance when placed on the ground at any angle up to some maximum deviation from vertical, and unsupported. For example, if the golfer shown in FIG. 5 were to release the shaft of the putter, said putter would remain stationary on the putting surface at the angle at which it is released. This function of the outriggers is to provide weight for such a neutral-balanced golf club, not spontaneously returning to vertical when released, nor dropping to the ground.

The use of outriggers as defined above is one means for achieving the neutral balance required of the present golf club. However, any other of distribution of weight along the upper surface of the club can be used to provided the required neutral balance. It is convenient to use outriggers as defined above, but any other means of adding balancing weight to the upper surface of the putter can be used with equal effect.

This combination of curved surface, 4 and outriggers, 5 should be contrasted with the "V" shaped golf club described by Geundling. The effect of the "V" shape is apparently to provide just such a balanced equilibrium for Guendling's club when placed in a position having the shaft deviating from vertical. However, as noted above, this "V" design brings with it certain comprises in the putting stroke, especially when used in a vertical position as shown in FIG. 6 (and as suggested by Guendling). The present club overcomes this difficulty by proper choice of curvature and outrigger position and weight to achieve neutral balance away from vertical, without sacrificing flexibility in the golfer's choice of putting stroke.

Achieving neutral balance will depend on the size and weight of the shaft, the size, weight and material of the clubhead, and the distribution of mass within the clubhead. However, it has not been difficult in practice to design and construct outriggers meeting these criterion, providing a very flexible putter.

Typically, the outriggers will be integrally constructed as part of the clubhead during fabrication. This is certainly not necessary. It is quite possible to have outriggers constructed from different materials, or with variable weighing, although such clubs may not all be in compliance with the accepted rules of golf.

A very important feature of the present putter is the flexibility of putting stroke the golfer can use with this single club. The symmetry of the club allows it to be used by either right-handed or left-handed putters. The construction of the club allows it to be used as a conventional putter (FIG. 5), or in the modified croquet stroke suggested by Bernhardt. When combined with a short shaft, the present putter may be used in the putting stroke suggested by Guendling. Combined with a long shaft, the present putter can also be used in a variety of putting strokes utilizing balance from the shoulder or chest of the golfer. The curvature of the clubhead, 4, allows the present putter to be used in a conventional putting stroke at any angle desired by the golfer from true vertical (FIG. 6) to an angle deviating from true vertical by at least 10 degrees (FIG. 5). Such flexibility can be particularly important in choosing a comfortable putting stance when the putting surface is sloping (and, hence, the golfer's feet and the ball to be struck lie at different elevations).

The striking face of the clubhead, 3, can have almost any convenient perimeter outline for that surface contacting the golf ball. The structure shown in FIGS. 1–4 is a typical embodiment which has been shown to be convenient in practice for many golfers. The upper edge, 8, of the striking face, 3, is typically chosen to be at least 50% of the diameter of the golf ball. At a minimum, the width of the striking face is sufficiently large such that upper edge, 8, lies above the horizontal midplane of the golf ball during striking. Design of golf clubs with the upper striking edge, 8, lower than the horizontal midplane of the struck golf ball tend to undercut the golf ball, causing an initial jump in the ball when struck. This initial jump introduces an extra measure of unpredictability into the trajectory of the golf ball; already an uncertain process. Thus, it is preferred for most putters that the upper edge of the striking surface of the clubhead contact the golf ball above the ball's horizontal midplane. Otherwise, the profile of the striking face is a matter of balance and taste for each particular golfer.

I claim:

1. A golf club for use as a putter comprising;

a) a clubhead and a shaft rigidly connected at substantially a right angle to an upper surface of said clubhead and said shaft connected to said upper surface of said clubhead substantially in the center thereof; and b) said clubhead having its longer horizontal dimension perpendicular to the direction of striking a putt, and having a first substantially planar face for striking a golf ball, and having a curved lower surface opposite said upper surface such that both upright and side putting strokes contact the golf ball with substantially equivalent regions of said striking face, and c) said clubhead further comprising balanced weighting means located on the upper surface of said clubhead for balancing said clubhead such that said club remains motionless when placed unsupported on a horizontal surface with said club resting on said lower surface of said clubhead, for any placing orientation having said shaft making an angle in the range from true vertical to a deviation of at least 10 degrees from vertical along said longer dimension of said clubhead.

2. A golf club as in claim 1, further comprising a second, substantially planar striking face on the opposite side of said clubhead from said first striking face; and symmetrical positioning of said weighting such that left-handed or right-handed putting is equivalent.

3. A golf club as in claim 1, wherein said striking face is inclined with respect to vertical at an angle in the range from 0 degrees to approximately 2 degrees from said lower surface to said upper surface, said striking force tilted toward said shaft.

4. A golf club as in claim 1 wherein the perimeter of said striking face has an upper edge lying above the horizontal midplane of said golf ball for at least those regions of said striking face which contact said golf ball.

* * * * *